US009586743B2

(12) United States Patent
Carlson et al.

(10) Patent No.: US 9,586,743 B2
(45) Date of Patent: Mar. 7, 2017

(54) HANGING BAG

(75) Inventors: Paul Carlson, Appleton, WI (US); Myles Wegner, Appleton, WI (US); Steve Gucinski, Appleton, WI (US)

(73) Assignee: SCA HYGIENE PRODUCTS AB, Gothenburg (SE)

( * ) Notice: Subject to any disclaimer, the term of this patent is extended or adjusted under 35 U.S.C. 154(b) by 0 days.

(21) Appl. No.: 13/365,981

(22) Filed: Feb. 3, 2012

(65) Prior Publication Data

US 2013/0200093 A1 Aug. 8, 2013

(51) Int. Cl.

| | |
|---|---|
| ***A47K 10/42*** | (2006.01) |
| ***B65G 59/00*** | (2006.01) |
| ***B65G 59/06*** | (2006.01) |
| ***B65H 1/04*** | (2006.01) |
| ***B65D 75/56*** | (2006.01) |
| ***B65D 75/58*** | (2006.01) |
| ***B65D 83/08*** | (2006.01) |

(52) U.S. Cl.
CPC ..... *B65D 75/56* (2013.01); *B65D 75/5844* (2013.01); *B65D 83/0811* (2013.01); *B65D 2575/565* (2013.01); *B65D 2575/586* (2013.01)

(58) Field of Classification Search
CPC ..... B65D 75/56; B65D 75/5844
USPC ..... 221/45
See application file for complete search history.

(56) References Cited

U.S. PATENT DOCUMENTS

| | | | | |
|---|---|---|---|---|
| 1,764,673 | A * | 6/1930 | Babson | 221/48 |
| 1,797,380 | A | 3/1931 | Thompson | |
| 3,124,298 | A | 3/1964 | Repko | |
| 3,207,360 | A | 9/1965 | Douglas | |
| 4,570,820 | A * | 2/1986 | Murphy | 221/34 |
| 4,650,079 | A * | 3/1987 | Tani | B65D 75/68 206/484 |
| 4,658,962 | A * | 4/1987 | Burns et al. | 206/554 |

(Continued)

FOREIGN PATENT DOCUMENTS

| | | |
|---|---|---|
| WO | 02/051294 A2 | 7/2002 |

OTHER PUBLICATIONS

International Search Report and Written Opinion of the International Searching Authority, issued Apr. 22, 201 in corresponding PCT Application No. PCT/SE2013/050068 (10 pages).

(Continued)

*Primary Examiner* — Michael K Collins
(74) *Attorney, Agent, or Firm* — Buchanan Ingersoll & Rooney PC

(57) ABSTRACT

A packaged product including a substantially enclosed container for a material, said container including a first end, a second end with a width and a length, a sidewall forming an interior surface defining the container, a first opening into the container adapted to dispense the material, a hanging member, and an insert with an insert base portion, two insert side portions and an insert opening along a width of the insert, wherein the insert base portion extends along the width of the second end, the insert side portions extend at least partially up the sidewall, and the insert opening extends along at least substantially the entire width of the second end. A dispensing method including providing a packaged product, opening the packaged product to form a first opening into the container adapted to dispense a material, and dispensing the material from the container.

20 Claims, 8 Drawing Sheets

(56) References Cited

U.S. PATENT DOCUMENTS

| | | | | | |
|---|---|---|---|---|---|
| 4,678,099 | A * | 7/1987 | Matsui | B65D 83/0811 | 221/48 |
| 4,848,575 | A | 7/1989 | Nakamura et al. | | |
| 5,375,930 | A * | 12/1994 | Tani | B65D 33/2533 | 383/104 |
| 5,390,820 | A * | 2/1995 | Wright et al. | 221/52 | |
| 5,518,144 | A * | 5/1996 | Samuelson et al. | 221/33 | |
| 5,540,354 | A | 7/1996 | Annand | | |
| 5,906,278 | A * | 5/1999 | Ponsi et al. | 206/494 | |
| 5,950,863 | A | 9/1999 | Schultz et al. | | |
| 6,354,462 | B1 | 3/2002 | Conran et al. | | |
| 6,439,386 | B1 | 8/2002 | Sauer et al. | | |
| 6,769,565 | B2 * | 8/2004 | Tramontina et al. | 221/45 | |
| 6,840,401 | B2 * | 1/2005 | Amundson | 221/56 | |
| 6,877,634 | B2 | 4/2005 | Tramontina et al. | | |
| 7,887,146 | B1 * | 2/2011 | Louie | A61J 1/16 | 211/85.15 |
| 2002/0092789 | A1 | 7/2002 | Sauer et al. | | |
| 2013/0200093 | A1 * | 8/2013 | Carlson | B65D 75/56 | 221/1 |

OTHER PUBLICATIONS

Written Opinion of the International Preliminary Examining Authority issued Feb. 11, 2014 in PCT/SE2013/050068.

* cited by examiner

FIG. 5A
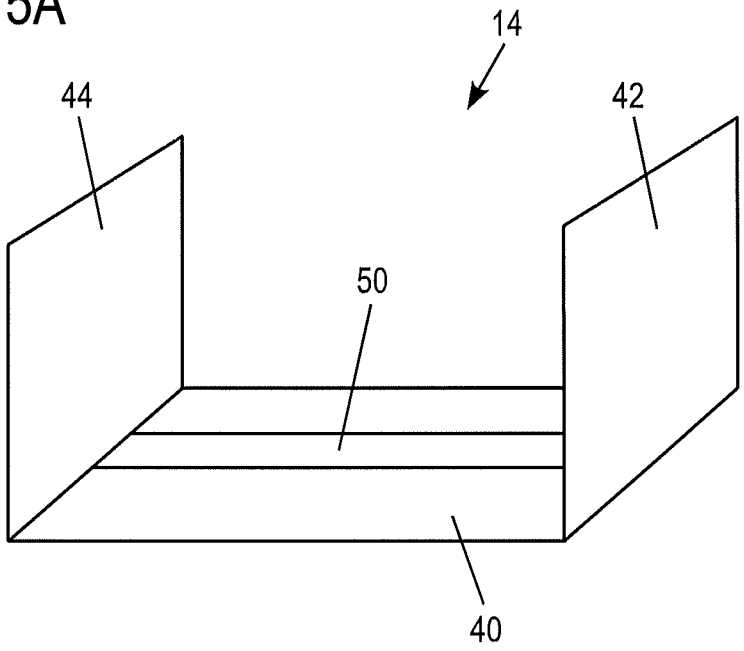
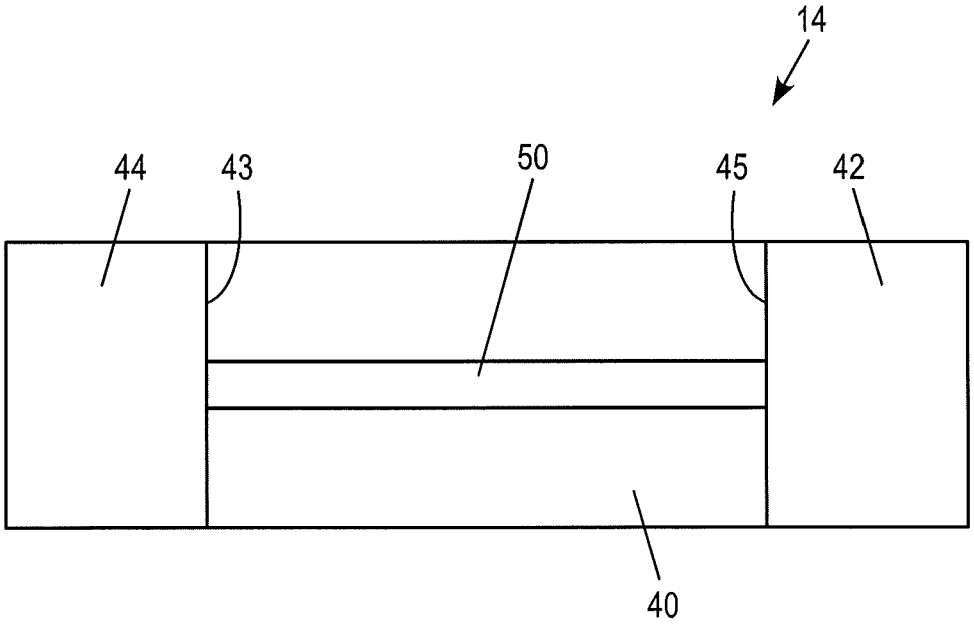
FIG. 5B

HANGING BAG

TECHNICAL FIELD

Embodiments of the present disclosure relate to a hanging product including a paper or nonwoven material in a container, and the container for the paper or nonwoven material.

BACKGROUND

There is an ever-increasing demand for novel ways to dispense paper materials such as facial tissue, bathroom tissue, paper towels, napkins, absorbent paper, wet wipes and the like.

In particular, with the increase in the number of items stored on counters and shelves and the resulting decrease in available counter space, there is a need to provide hanging dispensing products of paper materials, which reduce or eliminate the amount of counter space required. Thus, hanging dispensers or products, which eliminate the need for any counter space usage, are consumer preferred.

In addition, paper materials are frequently used in areas with exposure to liquids and moisture such as kitchens, bathrooms, restaurants and food carts. Conventional cartons of paper materials, when placed on counters, can be damaged by associated liquid spills. By providing a dispenser that hangs, the product's usefulness to consumers is enhanced.

Conventional hanging products have various issues with the dispensing function of each. For example, known hanging products are described in U.S. Pat. No. 6,439,386, U.S. Pat. No. 6,769,565, and U.S. Pat. No. 6,877,634, each assigned on its face to Kimberly-Clark Worldwide, Inc.

Thus, there is a need to provide an economical solution to the problem of how a hanging dispenser functions. For example, there is a need to provide an improved dispensing function, where paper materials can be dispensed with minimal effort, minimal tearing, and/or minimal wadding. For example, there is a need to improve the dispensing of the entire stack of paper material. For example, there is a need to ensure that the last few paper materials (e.g., 10-50 napkins) will individually dispense, instead of falling out of the end of the container or dispensing simultaneously.

For the foregoing reasons, there is a need for a hanging product including a paper material in a container, and the container for the paper material, that reduces the need to place the dispenser on a counter, while providing dispensing with minimal effort, minimal tearing, and/or minimal wadding, and/or improved dispensing characteristics that address other drawbacks of conventional hanging products.

SUMMARY

In embodiments, the disclosure relates to a packaged product may include a substantially enclosed container for a paper or nonwoven material; said container may include: a first end, a second end with a width and a length, a sidewall forming an interior surface defining the container, a first opening into the container adapted to dispense the paper or nonwoven material, and an insert with an insert base portion, two insert side portions and an insert opening along a width of the insert. The insert base portion may extend along the width of the second end, the insert side portions may extend at least partially up the sidewall, and the insert opening may extend along at least substantially the entire width of the second end.

In embodiments, the container may include a hanging member.

In embodiments, the packaged product may include a stacked paper or nonwoven material. The stacked paper or nonwoven material may be an interfolded paper or nonwoven material. The container may be disposable upon depletion of the paper or nonwoven material. The container may fully enclose the paper or nonwoven material except for the opening.

In embodiments, the insert opening may extend along the entire width of the second end. The insert opening may extend into the insert side portions, such that at least a portion of the insert opening extends along the sidewall.

In embodiments, the first opening may extend along at least substantially the entire width of the second end. The first opening may extend along the entire width of the second end. The first opening may extend into the sidewall. The first opening may be substantially the same size and shape as the insert opening.

In embodiments, the insert side portions may extend along the sidewall for a range of 10 to 100 mm. The insert side portions may extend at least halfway along the height of the sidewall.

In embodiments, the insert may have two fold lines, one between the insert base portion and each insert side portion. The insert side portions may meet the insert base portion an angle of 90°±5°. The insert base portion base portion may be relatively flat, such that the insert base portion has a bowing height change of less than 10% of the width of the base portion.

In embodiments, the first opening is formed by pulling apart the second end at a perforation line. The first opening may be formed by removing a removable strip, created by at least two lines of perforation. The first opening may comprise a protective film with a dispensing slit. The first opening may be formed by partially removing a removable strip, created by at least two lines of perforation, wherein the partially removed strip forms a resealable flap for resealing the container.

In embodiments, the sidewall may include four panels and the container is generally a right cuboid.

In embodiments, the disclosure relates a container for dispending folded napkins, wherein when folded, each of the napkins is substantially rectangular having parallel first edges and parallel second edges, the dispenser including: a generally rectangular plastic bag having a first end, a second end, and four sidewalls; a hanging member; and an insert arranged in the bag above the second end. The second end may have a rectangular shape having parallel first edges and parallel second edges that are substantially a same size, respectively, as the parallel first edges and parallel second edges of each of the folded napkins. The second end may have a first opening extending along at least substantially the entire width thereof, through which the napkins are dispensed. The insert may have an insert base portion, two folded insert side portions, and an insert opening through which the napkins are dispensed. The insert base portion may have substantially a same size, respectively, as the parallel first edges and parallel second edges of the second end, and each side portion of the cardboard insert is folded at an angle so as to be parallel with and to provide support for two of the four sidewalls. The insert opening may extend along at least substantially the entire width of the second end.

In embodiments, the disclosure relates a method for dispensing a paper or nonwoven material, the method comprising: providing an embodiment of a disclosed packaged product; opening the packaged product to form a first opening into the container adapted to dispense the paper or nonwoven material; and dispensing the paper material from the container.

In embodiments, the step of opening the packaged product may include pulling apart the second end at a perforation line. The step of opening the packaged product may include removing a removable strip, created by at least two lines of perforation. The step of opening the packaged product may include partially removing a removable strip, created by at least two lines of perforation, wherein the partially removed strip forms a resealable flap for resealing the container.

DESCRIPTION THE DRAWINGS

These and other features, aspects, and advantages of the present invention will become better understood with regard to the following description, appended claims, and accompanying drawings where:

FIG. 5A is a perspective view of an insert, as the insert would be formed in use in a container, with the insert opening extending along the base portion;

FIG. 5B is a top view of an insert in flat form, with the insert opening extending along the base portion;

DETAILED DESCRIPTION

Figure 1A:
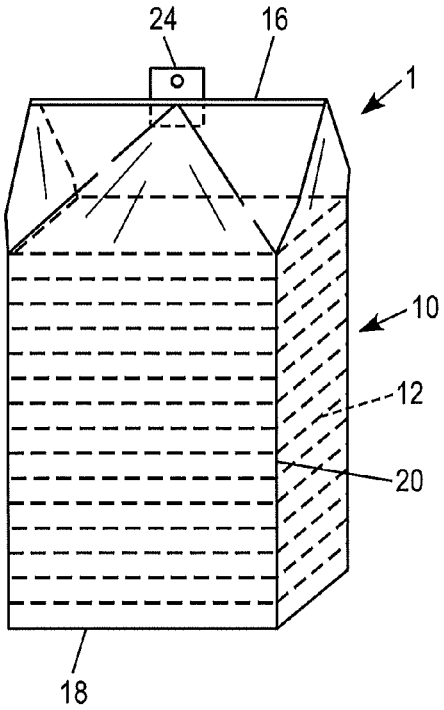
FIG. 1A is a perspective view of a container according to an embodiment of the disclosure, wherein a stacked paper material is shown in phantom.
Figure 1B:
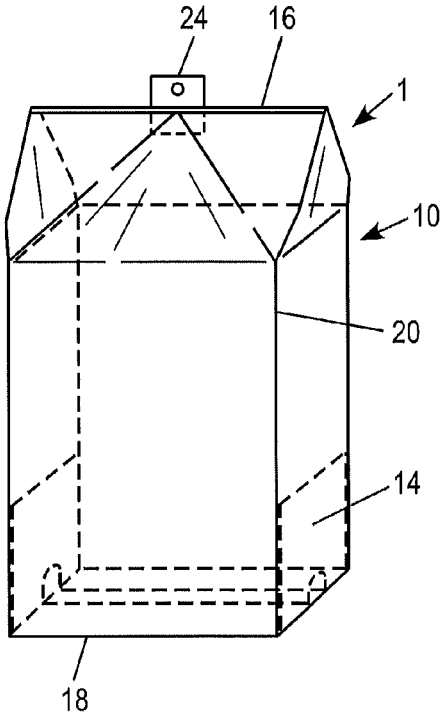
FIG. 1B is a perspective view of a container according to an embodiment of the disclosure, wherein an insert is shown in phantom.
Figure 1C:
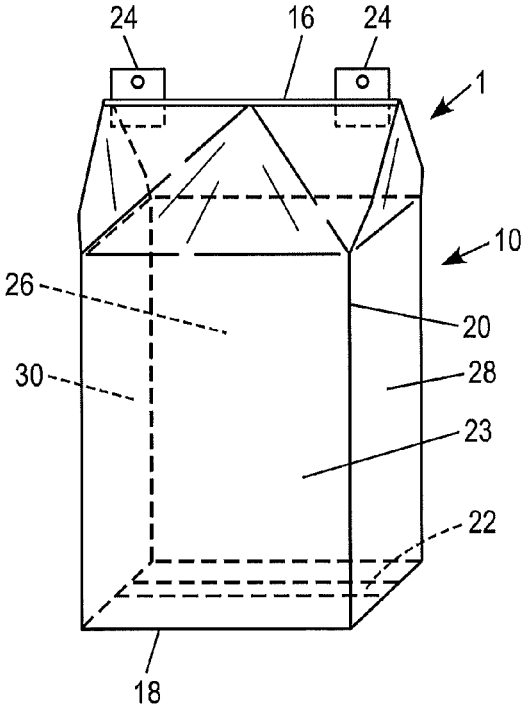
FIG. 1C is a perspective view of a container according to an embodiment of the disclosure, wherein a first opening of the container is shown in phantom.

With reference to the figures, and more particularly to FIGS. 1A-C, an exemplary hanging product 1 is illustrated. While these and other figures refer to a hanging product, it is contemplated that the description herein and accompanying figures are applicable to other types of hanging products, and therefore not limited to the embodied hanging product.

The disclosure describes various embodiments and the separate discussion of each should not be construed to limit the invention, or otherwise to exclude any other embodiments, adaptations, variations, modifications and equivalent arrangements. Features from the various embodiments may be combined together with features from other embodiments.

Referring to FIGS. 1A-C, a product 1 including a container 10 and a stack of paper material 12 is shown. The container includes an insert 14. Embodiments of the insert 14 hold the paper material flat, or relatively flat, for proper dispensing, while preventing the sides of the container from applying too much pressure to the sides of the paper material. Too much pressure to the sides of the paper material 12 may cause the paper material to tear and/or wad while dispensing, or to dispense multiple paper products at once, or other functional issues.

The container 10 may be any size or shape useful for containing the paper material 12. The container 10 may be sized small enough so as to keep the paper material 12 from moving around in the container 10, but large enough to not restrict the dispensing of the paper material 12.

Referring to FIGS. 1A-C, the container 10 includes a first end 16, a second end 18, a sidewall 20 forming an interior surface defining the container, a first opening 22 into the container adapted to dispensing the paper material, and a hanging member 24. FIG. 1C shows an embodiment with two hanging members 24, on either side of the first end 16.

In FIG. 1C, the first opening 22 is in the second end 18. The second end 18 can be any size or shape. For example, the second end 18 is substantially the same size and shape as bottom size and shape of the stack of paper material 12 being dispensed. In an embodiment, the area of the second end 18 may range from the same area as the bottom of the stack of paper material 12 to 5% bigger in area, or to 10% bigger in area.

In FIG. 1C, the container 10 has a sidewall 20 comprised of four panels 23, 26, 28 and 30. The container 10 is generally a right cuboid, with generally rectangular faces. Generally rectangular means that at least second end of the container 10 is rectangular or square, although not all sides of the container 10 necessarily meet at right angles. Thus, a three dimensional parallelogram is generally rectangular. Further, the first end 16 and second end 18 may be of the same size and shape, or may have different sizes and shapes. For example, in a hanging bag, the second end 18 may be rectangular or square, and the first end may be arranged in a line with essentially no area. Further, it is possible to construct the container 10 in a cylindrical shape or any other three-dimensional volume by use of a differently shaped sidewall and/or end panels. For instance, a cylindrical container would have one sidewall and two circular ends.

The container 10 may be of any material useful for containing the paper material 12. For example, the material may be a plastic, such that the container is a plastic bag. Exemplary plastic materials include, but are not limited to, thermoplastics and thermosetting polymers, including polyethylene, polypropylene, polystyrene, polyvinyl chloride, and polytetrafluoroethylene (PTFE). The material may be biodegradable, for example a plastic comprising corn starch. For example, the material may be a cardboard, carton stock, heavy paper, and the like. The material may be coated with a wax, strengthening agent, friction reducing agent or a waterproofing agent.

In an embodiment, the container 10 is a poly bag that is gravity fed.

In an embodiment, the absorbent paper material 12 is substantially in contact with an interior surface of sidewall 20 of the container 10, and not housed within a second container or carton. The interior surface may be treated with a friction reducing agent.

In an embodiment, the container 10 is disposable upon depletion of the paper material 12. In an embodiment, the container 10 is refillable upon depletion of the paper material 12. A refillable container could be used with a paper material purchased in bulk.

A first opening 22 is provided into the interior of the container 10. In an embodiment, the first opening 22 is located in the second end 18. In an embodiment, the first opening 22 is the only opening into the interior of the container 10.

Any size, style, or location of opening configured to dispense a paper material 12 through the endwall from the interior of the container 10 is possible. The type of paper material 12 being dispensed may dictate the style or size of opening. For example, the opening may be a slit, an oval, a rectangle, a square, a circle, a dog bone, a curved shape, an S-shape, or the like.

In an embodiment, the first opening 22 extends across the width of the container 10. The width being the direction of the first opening 22, the length being a perpendicular direction. The width may be the entire width or at least substantially the entire width. For example, the first opening 22 may extend across at least the width of the paper material 12 in the container 10. For example, the first opening 22 may extend across an entire width of the container 10, but not extend up the sidewall 20. Alternatively, the first opening 22 extends across an entire width of the container 10 and extends slightly up the sidewall, such as up to 25 mm.

Figure 2A:
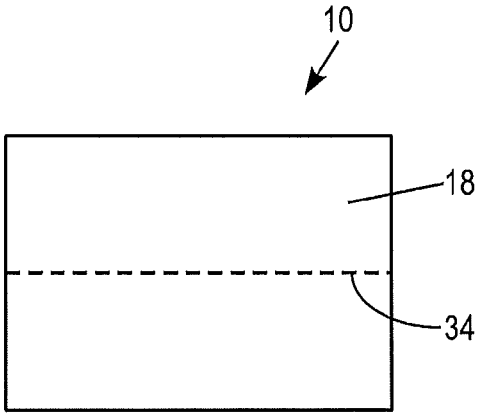
FIG. 2A is a bottom view of the second end of a container according to an embodiment of the disclosure, wherein a perforation line is shown.
Figure 2B:
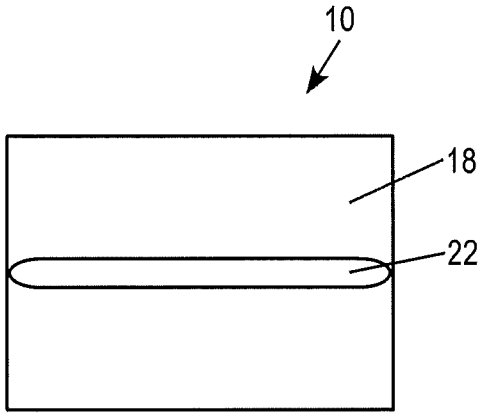
FIG. 2B is a bottom view of the second end of a container according to an embodiment of the disclosure, wherein a first opening, from pulling apart a perforation line, is shown.

Referring to an embodiment in FIGS. 2A,B, the first opening 22 may be formed by pulling apart the material of the second end 18. This may be done at a perforation line 34.

Figure 2C:
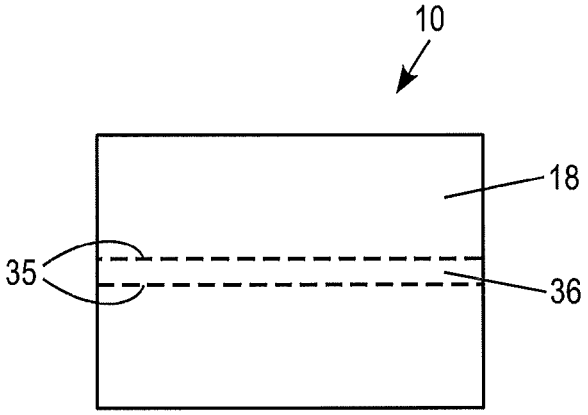
FIG. 2C is a bottom view of the second end of a container according to an embodiment of the disclosure, wherein a removable strip is shown.
Figure 2D:
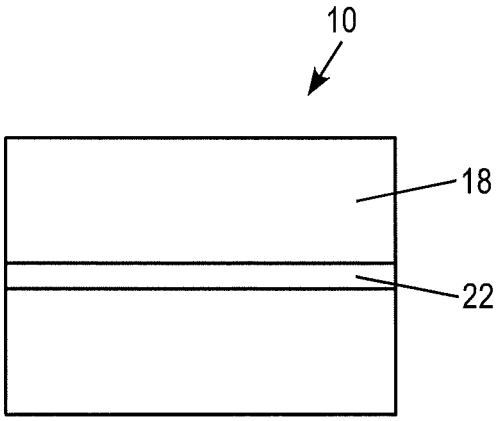
FIG. 2D is a bottom view of the second end of a container according to an embodiment of the disclosure, wherein a first opening, created by pulling away a removable strip, is shown.

Referring to an embodiment in FIGS. 2C,D, the first opening 22 may be covered by at least one removable strip 36 as is conventionally practiced with facial tissue cartons. For instance, a removable strip 36 may be created by lines of perforation 35 in the container 10. The removable strip 36 is stripped from the container 10 prior to dispensing the paper material 12. The first opening 22 may be formed by pulling off the removable strip 36, e.g., a strip of material on the second end 18. The removable strip 36 may be formed integrally with the material of the second end 18. The removable strip 36 may have a uniform width of, for example, from 1 mm to 25 mm, or from 5 mm to 15 mm.

The removable strip 36 may be completely removed or partially removed from the container 10 when forming the first opening 22. When the removable strip 36 is partially removed from the container 10, the strip 36 may act as a tab or flap that can reseal with the container 10 to protect the paper material 12.

Figure 2E:
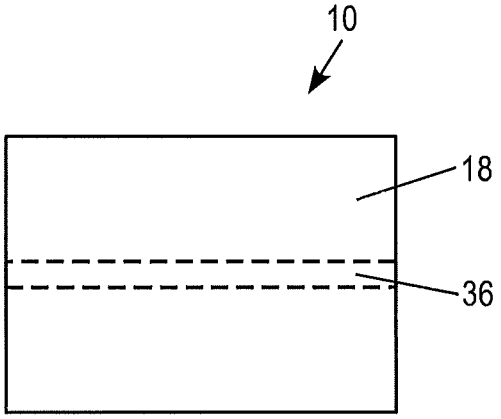
FIG. 2E is a bottom view of the second end of a container according to an embodiment of the disclosure, wherein a removable strip is shown.
Figure 2F:
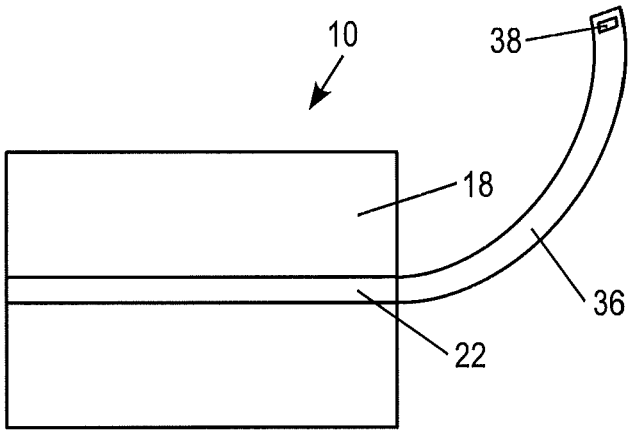
FIG. 2F is a bottom view of the second end of a container according to an embodiment of the disclosure, wherein a first opening, from pulling away part of a removable strip to form a resealable flap, is shown.

Referring to an embodiment in FIGS. 2E,F, one end of the strip 36 may include an attachment device 38, such as an adhesive or adhesive receiving area, in order to reattach the strip 36 to the container 10 for sealing.

Figure 2G:
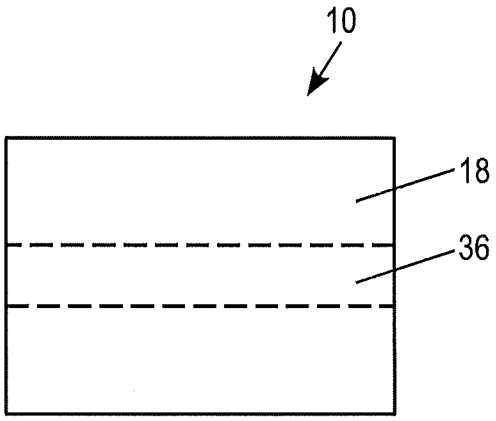
FIG. 2G is a bottom view of the second end of a container according to an embodiment of the disclosure, wherein a removable strip is shown.
Figure 2H:
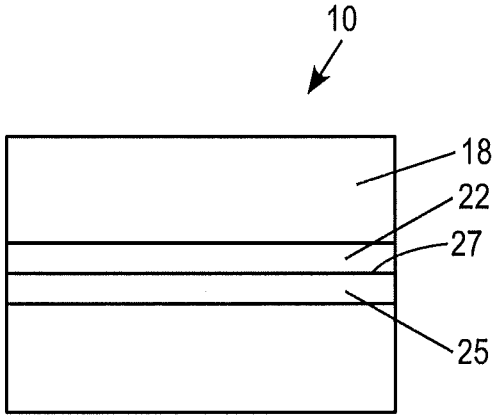
FIG. 2H is a bottom view of the second end of a container according to an embodiment of the disclosure, wherein a first opening, created by pulling away a removable strip, and a protective film is shown.

Referring to an embodiment in FIGS. 2G,H, a removable strip 36 may be removed to form the first opening 22. The first opening 22 may include a protective film 25 with a dispensing slit 27.

The first opening 22 may be pre-formed, for example by cutting the material of the second end 18 during manufacture. The pre-formed first opening 22 can be covered by a removable sheet of protective material (not shown).

Figure 3A:
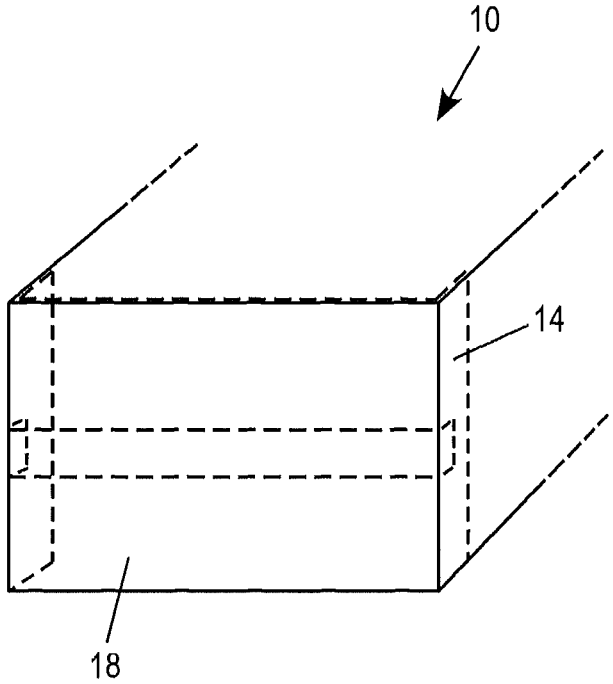
FIG. 3A is a bottom perspective view of a container, wherein an insert covering the entire area of a second end is shown in phantom.
Figure 3B:
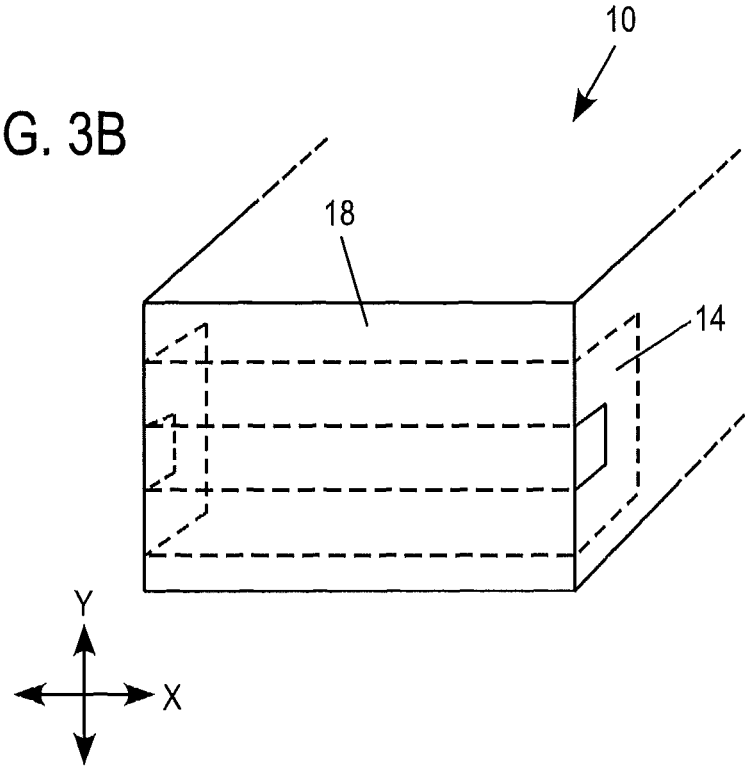
FIG. 3B is a perspective view of a container, wherein an insert extending the entire width, but not length, of a second end, is shown in phantom.

Referring to an embodiment in FIG. 3A, the insert 14 covers the entire area of the second end 18. Alternatively, in an embodiment in FIG. 3B, the insert 14 extends the entire width (X) of the second end area 18, but may not extend the length (Y) of the second area 18.

The insert 14 extends across an entire width of the container 10 and up at least a portion of each respective sidewall. Referring to an embodiment in FIGS. 4A,B, the insert 14 has a base portion 40 and two side portions 42, 44. For example, the side portions 42, 44 may extend far enough up the sidewall to provide support for the overall insert 14, and to ensure that the base portion 40 stays flat. The side portions 42, 44 may extend only slightly up the sidewalls, for example, from 10 mm to 100 mm, or from 40 mm to 80 mm, or from 60 mm to 80 mm. Alternatively, the side portions 42, 44 may extend at least halfway up the sidewalls or substantially all the way up the sidewalls.

The insert 14 may have fold or scoring lines 43,45 where the side portions 42,44 meet the base portion 40 in order to ensure a sharp bending, and not a gentle bending. In an embodiment, the side portions 42,44 meet the base portion 40 at a 90°±5° angle.

The insert 14 may be formed from a rectangular piece of material. Alternatively, the insert 14 may be shaped so that the side portions 42, 44 are rounded.

The insert 14 has an insert opening 50 that may be designed to match the first opening 22 of the container 10. Alternatively, the insert opening 50 may have different size or shape than the first opening 22. Any size, style, or location of opening configured to dispense a paper material 12 through the insert 14 from the interior of the container 10 is possible. The type of paper material 12 being dispensed may dictate the style or size of insert opening 50. For example, the opening may be a slit, an oval, a rectangle, a square, a circle, a dog bone, a curved shape, an S-shape, or the like.

Figure 4A:
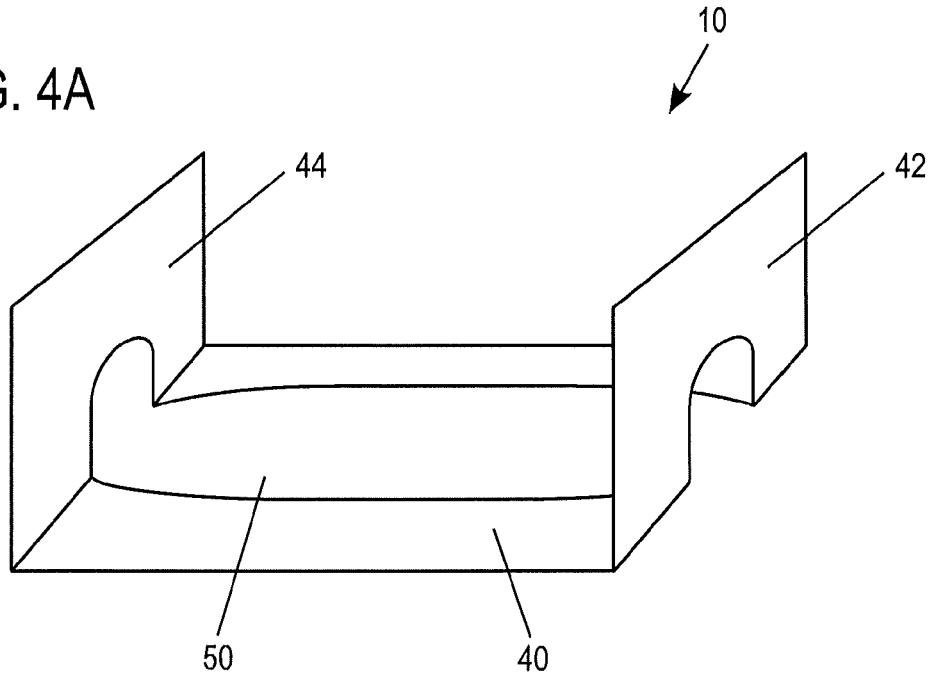
FIG. 4A is a perspective view of an insert, as the insert would be formed in use in a container, with the insert opening extending into insert side portions.
Figure 4B:
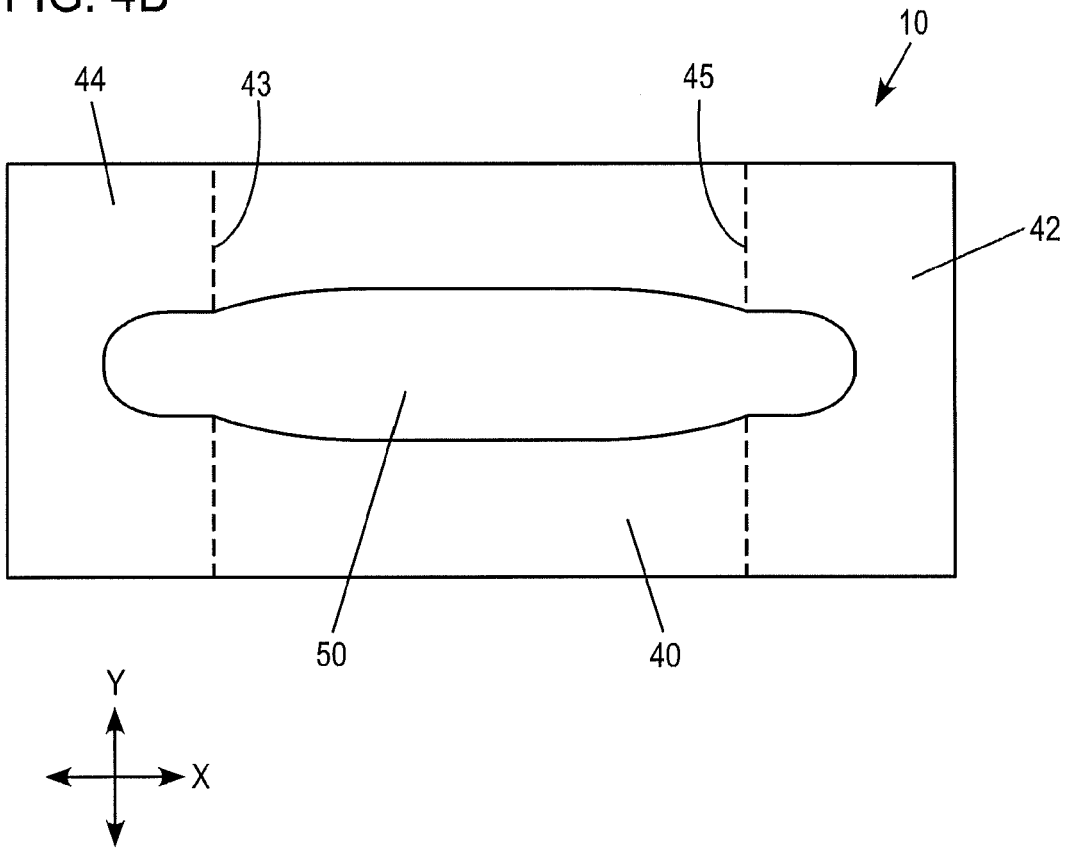
FIG. 4B is a top view of an insert in flat form, with the insert opening extending into insert side portions.

Referring to an embodiment in FIGS. 4A,B, the insert opening 50 extends across an entire width of the container 10 and into the side portions 42,44. The opening 50 may extend 10-100 mm, or from 30-50 mm into the portions 42, 44. Referring to an embodiment in FIGS. 5A,B, the insert opening 50 extends across the width of the second end area 18, but does not extend up the sidewall 20. This may be the entire width or at least substantially the entire width. For example, the insert opening 50 extends across at least the width of the paper material 12 in the container 10.

In an embodiment, the base portion 40 lays flat at the second end 18, and holds the paper material flat, or relatively flat, for proper dispensing, without adding too much pressure to the sides of the paper material 12, which may cause the napkins to tear and/or wad while dispensing. Relatively flat indicates that the base portion 40 experiences relatively little bowing. For example, the base portion 40 may have bowing height change of less than 10%, or less than 5%, of the width (X) of the base portion 40.

In an embodiment, the insert 14 will allow the paper material to dispense in an uninterrupted manner, such that the paper material displays essentially perfectly. For example, embodiments provide an improved dispensing function, where paper materials can be dispensed with minimal effort, minimal tearing, and/or minimal wadding. For example, embodiments improve the dispensing of the entire stack of paper material. For example, embodiments ensure that the last few paper materials (e.g., 10-50 napkins) will individually dispense, instead of falling out of the end of the container or dispensing simultaneously.

Figure 6:
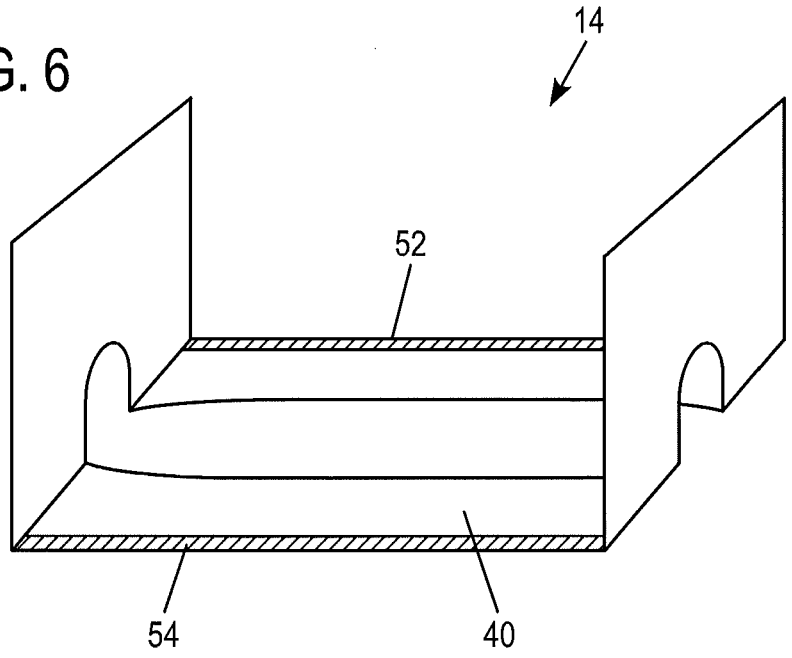
FIG. 6 is a perspective view of an insert, as the insert would be formed in use in a container, with the insert including support beams.

Referring to an embodiment in FIG. 6, the base portion 40 may include support beams 52,54 to help prevent the base portion 40 from bowing. The beams 52,54 may be separate material, such as metal, wood, plastic, cardboard, or may be a part of the material of the base portion 40 folded over onto the base portion 40.

Figure 7:
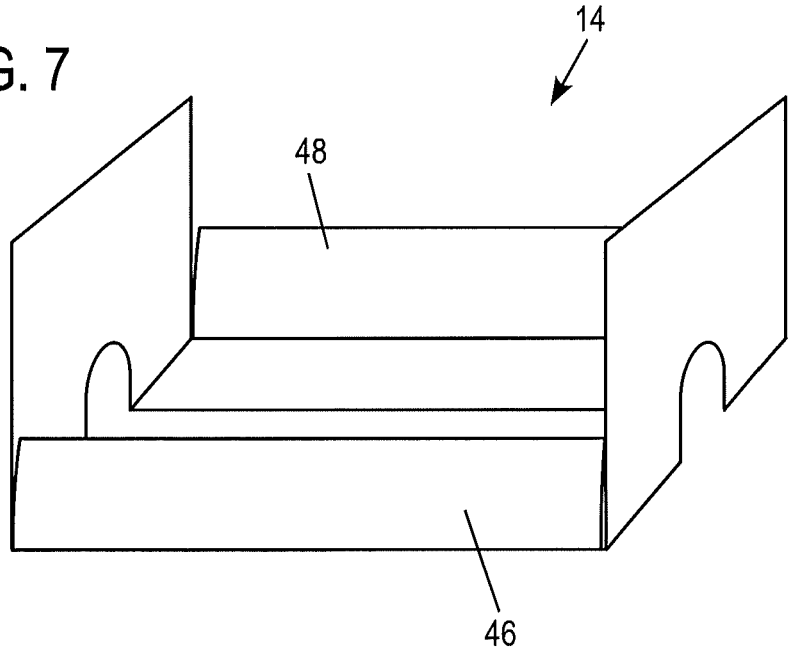
FIG. 7 is a perspective view of an insert, as the insert would be formed in use in a container, with the insert including additional side portions.

Referring to an embodiment in FIG. 7, the insert 14 may include the base portion 40, the two side portions 42,44 and two additional side portions 46,48.

The insert 14 may be of any material useful for supporting the paper material 12. For example, the material may be plastic, cardboard, carton stock, heavy paper, and the like. The insert 14 may be corrugated for extra stability. The corrugation direction may be in the width (X) direction of the insert 14. The material may be coated with a wax, strengthening agent, friction reducing agent or a waterproofing agent.

In an embodiment, the insert may be of the same material as the container 10. For example, the insert may be integrally formed with the container The paper material 12 may be napkins, absorbent paper, bathroom tissue, facial tissue, toilet paper, paper towels, wet wipes, dry wipes and the like. While paper material is mentioned, other material, such as nonwoven material, a natural material, or a synthetic material may be contained in the container 10. The paper material 12 may be stacked. The paper material 12 may be interfolded, which may assist with dispensing. Exemplary embodiments for how the paper material can be interfolded are described in U.S. Pat. No. 7,611,765, which is expressly incorporated herein by reference. The interfolded paper material 12 may substantially rectangular having parallel first edges and parallel second edges. The paper material 12 may be connected with perforated attachment lines.

The paper material 12 may be single ply paper napkins having a basis weight of at least 8 lb per unfolded sheet, for example from 8 to 30 lb per unfolded sheet, for example about 10 to 20 lb per unfolded sheet. The expression of basis weight in pounds as used herein is with reference to a stack of 500 unfolded single ply sheets each measuring 24 by 36 inches.

In an embodiment, the container 10 may hold at least 50 napkins, for example at least 400 napkins, for example at least 500 napkins, for example 50 to 1000 napkins.

The container 10 may include an attachment member 60, from which to hang the container 10 for dispensing. The attachment member 60 should be sturdy enough to allow for hanging of the container 10, and to withstand the force of withdrawing a paper product 12 and the force of being bumped into. Examples of attachment members, by way of illustration and without limitation, include adhesives, hook and loop materials, tabs and slots, lines of perforation with or without a strip, clips, and hooks. For example, the attachment member 60 may be a single member placed at the center of the width of first end 16. For example, the attachment member 60 may be two members, placed on either side of the width of the first end 16. For example, the attachment member 60 may be a hanger, either inserted into the container 10 or attached to the exterior of the container 10. For example, the attachment member 60 may be a hole(s) in the container, optionally a reinforced hole(s). For example, the container may have a double seal with a hole(s) through multiple layer of material.

While the invention has been described herein in detail in relation to specific embodiments, it is to be understood that this disclosure is only illustrative and exemplary of the invention, and is made merely for purposes of providing a full and enabling disclosure of the invention. The foregoing disclosure is not intended to be construed to limit the invention, or otherwise to exclude any other embodiments, adaptations, variations, modifications and equivalent arrangements; the invention being limited only by the claims appended hereto and the equivalents thereof.

The invention claimed is:

1. A packaged product comprising:

a substantially enclosed container for a paper or nonwoven material;

said container comprising:

a bag with:

a first, top end, a second, bottom end with a width and a length forming a second end surface area, a sidewall forming an interior surface defining the container, and a first opening into the container adapted to dispense the paper or nonwoven material, and an insert with an insert base portion with a length and a width forming an insert base portion surface area, two insert side portions, each insert side portion extending to a terminal end of the insert defining a boundary of the insert, and an insert opening along a width of the insert, wherein:

substantially the entire insert base portion surface area abuts the second end surface area, the insert base portion extends along the width of the second end, the insert side portions extend at least partially up the sidewall to the respective terminal end, each terminal end of the insert being directly adjacent the sidewall, and the insert opening extends along at least substantially the entire width of the second end, the first opening is in the second end, the first opening is the bottommost opening of the container, and wherein the first opening is directly adjacent the insert, and the insert opening extends into the insert side portions, such that at least a portion of the insert opening extends along the sidewall.

2. The packaged product of claim 1, wherein the packaged product comprises stacked paper or nonwoven material, preferably in an interfolded configuration.

3. The packaged product of claim 1, wherein the first opening extends along at least substantially the entire width of the second end.

4. The packaged product of claim 3, wherein the first opening extends along the entire width of the second end.

5. The packaged product of claim 4, wherein the first opening extends along the sidewall.

6. The packaged product of claim 1, wherein the first opening is substantially the same size and shape as the insert opening.

7. The packaged product of claim 1, wherein the insert side portions extend along the sidewall for a range of 10 to 100 mm.

8. The packaged product of claim 1, wherein the insert side portions extend at least halfway along the height of the sidewall.

9. The packaged product of claim 1, wherein the insert has two fold lines, one between the insert base portion and each insert side portion.

10. The packaged product of claim 9, wherein the insert side portions meet the insert base portion an angle of 90°±5°.

11. The packaged product of claim 1, wherein the insert base portion base portion is relatively flat, such that the insert base portion has a bowing height change of less than 10% of the width of the base portion.

12. The packaged product of claim 1, wherein the first opening is formed by pulling apart the second end at a perforation line.

13. The packaged product of claim 1, wherein the first opening is formed by removing a removable strip, created by at least two lines of perforation.

14. The packaged product of claim 13, wherein the first opening comprises a protective film with a dispensing slit.

15. The packaged product of claim 1, wherein the first opening is formed by partially removing a removable strip, created by at least two lines of perforation, wherein the partially removed strip forms a resealable flap for resealing the container.

16. The packaged product of claim 1, wherein the container further comprises a hanging member.

17. The packaged product of claim 1, wherein the insert is freely placed against the remainder of the container, such that the insert is not attached to the remainder of the container.

18. The packaged product of claim 1, wherein the insert base portion has a bowing height change of less than 10% of the width of the insert base portion.

19. A container for dispending folded napkins, wherein when folded, each of the napkins is substantially rectangular having parallel first edges and parallel second edges, the container comprising:

a generally rectangular plastic bag having a first, top end, a second, bottom end, and four sidewalls; and an insert arranged in the bag above the second end, wherein:

the second end has a rectangular shape having parallel first edges and parallel second edges that are substantially a same size, respectively, as the parallel first edges and parallel second edges of each of the folded napkins, the rectangular shape forming a second end surface area, the second end has a first opening extending along at least substantially the entire width thereof, through which the napkins are dispensed, the insert has an insert base portion with a length and a width forming an insert base portion surface area, two folded insert side portions, each insert side portion extending to a terminal end of the insert defining a boundary of the insert, and an insert opening through which the napkins are dispensed, the insert base portion has substantially a same size, respectively, as the parallel first edges and parallel second edges of the second end, and each side portion of the insert is folded at an angle so as to be parallel with and to provide support for two of the four sidewalls, each insert side portion extending to the respective terminal end, each terminal end of the insert being directly adjacent the sidewall, substantially the entire insert base portion surface area abuts the second end surface area, the insert opening extends along at least substantially the entire width of the second end, the first opening is in the second end, the first opening is the bottommost opening of the container, and wherein the first opening is directly adjacent the insert, and the insert opening extends into the insert side portions, such that at least a portion of the insert opening extends along the sidewall.

20. The container of claim 19, the container further comprises a hanging member.

* * * * *